United States Patent [19]

Kimura

[11] Patent Number: 4,725,820

[45] Date of Patent: Feb. 16, 1988

[54] COMPOSITE DETECTOR

[75] Inventor: Tetsuo Kimura, Tokyo, Japan

[73] Assignee: Nittan Company, Limited, Tokyo, Japan

[21] Appl. No.: 881,607

[22] Filed: Jul. 3, 1986

[30] Foreign Application Priority Data

Jul. 22, 1985 [JP] Japan ..... 60-160280

[51] Int. Cl.[4] ..... G08B 19/00

[52] U.S. Cl. ..... 340/522; 340/508; 340/506; 340/517; 340/518; 340/511; 340/870.21

[58] Field of Search ..... 340/522, 521, 518, 511, 340/517, 506, 508, 531, 870.16, 870.17, 870.11–870.13, 870.21

[56] References Cited

U.S. PATENT DOCUMENTS 4,161,727 7/1979 Thilo et al. ..... 340/518
4,283,717 8/1981 Caldwell et al. ..... 340/511
4,339,746 7/1982 Ulicki et al. ..... 340/518
4,414,539 11/1983 Armer ..... 340/511
4,524,349 6/1985 Hyatt ..... 340/511
4,626,831 12/1986 Engel ..... 340/511

*Primary Examiner*—Donnie L. Crosland
*Attorney, Agent, or Firm*—Hill, Van Santen, Steadman & Simpson

[57] ABSTRACT

A composite detector includes a plurality of sensors of the same or different types, a plurality of analog switches connected to outputs of the plurality of sensors, and an operation circuit, such as an operational amplifier. The sensors detect physical phenomena such as heat, smoke and gas according to different principles of detection, and output analog detection signals. The analog switches are controlled by a selector operated with a control signal from a central monitor or magnitudes of outputs from the plurality of sensors. The operation circuit calculates outputs from the plurality of analog switches.

10 Claims, 2 Drawing Figures

COMPOSITE DETECTOR

BACKGROUND OF THE INVENTION

The present invention relates to a composite detector used in a fire alarm system or the like.

Some conventional fire detectors used in fire alarm systems independently detect at least two of the environmental parameters heat, light, smoke, and a combustible gas, add or multiply detected analog signals to or with each other, and generate fire alarm signals when the sums or products thereof exceed predetermined values, as described in Japanese Utility Model Publication No. 58-3189 (Fire Detector) and Japanese Patent Disclosure No. 54-77193 (Smoke Detector).

As described above, a fire alarm signal is output only if a value derived from outputs from different types of sensors in the conventional fire detector exceeds a predetermined value. A receiver (central monitor) automatically alarms or displays the fire alarm signal. With this function, the receiver cannot detect the type of signal received. In other words, the receiver cannot discriminate which one of the parameters heat, light and the like is detected according to analog signals from the sensors.

SUMMARY OF THE INVENTION

It is an object of the present invention to provide a composite detector for detecting the type of abnormality.

It is another object of the present invention to provide a composite detector for detecting an abnormal state with high reliability.

It is still another object of the present invention to provide a composite detector which requires a short data acquisition/processing time.

In order to achieve the above objects of the present invention, there is provided a composite detector comprising:

a plurality of sensors of the same or different types, for detecting physical phenomena such as heat, smoke and gas according to different principles of detection, and for outputting analog detection signals;

a plurality of analog switches connected to outputs of the plurality of sensors and controlled by a selector operated on the basis of a control signal from a central monitor or magnitudes of outputs from the plurality of sensors; and an operation circuit for calculating outputs from the plurality of analog switches.

According to the present invention, analog outputs from all or some of the plurality of sensors, or from individual analog sensors, can be extracted.

DESCRIPTION OF THE PREFERRED EMBODIMENTS

An embodiment of the present invention will be described with reference to the accompanying drawings.

Figure 1:
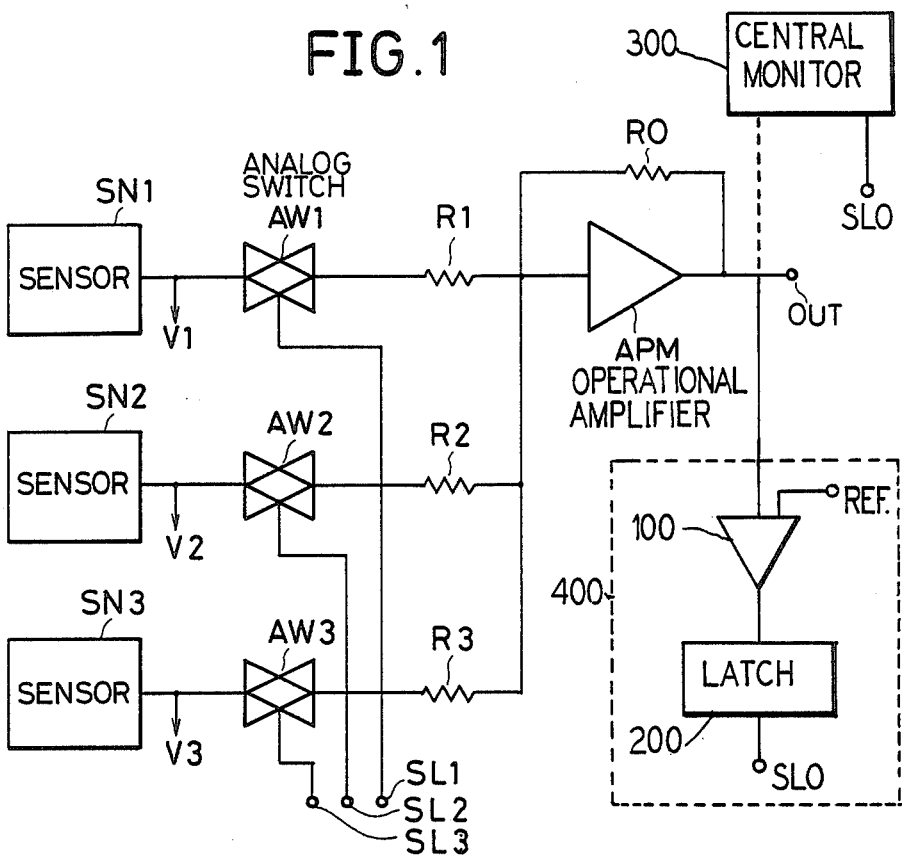
FIG. 1 is a block diagram of a composite detector according to an embodiment of the present invention.

FIG. 1 is a block diagram of a composite detector according to an embodiment of the present invention. The composite detector includes the same or different types of sensors SN1 to SN3 for detecting physical or environmental phenomena such as heat, smoke, and gas according to different principles of detection, and for outputting analog signals representing the different physical phenomena. The composite detector also includes analog switches AW1 to AW3 connected to outputs of the sensors SN1 to SN3; resistors R0 to R3; and an operational amplifier APM.

Control terminals SL1 to SL3 of the analog switches AW1 to AW3 and an output terminal OUT of the operational amplifier APM are connected to a central monitor 300 directly or through a transmission unit (not shown). The central monitor 300 determines environmental abnormality according to analog signals from the detector and produces an alarm or display in the abnormal mode.

The analog switches AW1 to AW3 are controlled by a selector (to be described with reference to FIG. 2) determined by the magnitudes of outputs from the sensors SN1 to SN3. In the normal monitor mode, the analog switches AW1 to AW3 are kept closed. The outputs from the sensors SN1 to SN3 are supplied to the operational amplifier APM through the analog switches AW1 to AW3. When resistances of the resistors R0 to R3 are set equal, a voltage of a magnitude corresponding to a sum of the output voltages V1 to V3 from the sensors SN1 to SN3 appears at the output terminal OUT. The output signal from the operational amplifier APM is supplied directly or indirectly to the central monitor 300. In other words, the central monitor can simultaneously monitor the sensors SN1 to SN3. If the central monitor sequentially accesses a plurality of composite detectors through a digital transmitting means, it can access many sensors without increasing the access cycle.

When an output signal from the composite detector exceeds a predetermined value, the central monitor outputs a control signal and accesses the sensors SN1 to SN3. The central monitor then detects the levels of the analog signals from the sensors SN1 to SN3. In addition, the central monitor can add the outputs from any of the sensors SN1 to SN3, extract a sum thereof, and determine that an environmental abnormality has occurred.

A selector can also be arranged in the composite detector described above. When the signal at the output terminal OUT of the operational amplifier APM exceeds a predetermined value, the selector controls the analog switches AW1 to AW3 and selects specific sensors according to the analog signals from the sensors SN1 to SN3. The analog signals are then sent to the central monitor. In this case, the control signal for the selector is also sent, so that the central monitor can detect which one of the sensors SN1 to SN3 is selected.

The selector used in the composite detector described above will be described with reference to FIG. 2. The selector comprises comparators CM1 to CM3, AND gates AND1 to AND3, and OR gates OR1 to OR3. One input of each of the AND gates AND1 to AND3 is inverted. One input of each of the comparators CM1 to CM3 is connected to a corresponding one of the outputs from the sensors SN1 to SN3. A terminal SL0 is normally kept high. However, when the output from the operational amplifier APM exceeds the predetermined value, the terminal SL0 goes low. Terminals SL1 to SL3 connected to the outputs of the OR gates OR1 to OR3 are control terminals for the analog switches AW1 to AW3, respectively. The terminals SL1 to SL3 are connected to the transmission unit or to the central monitor directly. Identification signals representing which sensor is used appear at the terminals SL1 to SL3.

The operation of the selector will be described hereinafter. Since the terminal LS0 is normally set at a high level, all the outputs from the OR gates OR1 to OR3 are kept high, and all the analog switches AW1 to AW3 are kept closed. The outputs from the sensors SN1 to SN3 are supplied to the operational amplifier APM. When the output from the operational amplifier APM exceeds a predetermined value, the terminal SL0 goes low. A control circuit 400 for controlling the terminal SL0 can be formed of a comparator 100 and a latch circuit 200. In this state, when the output from the sensor SN1 is the highest, the output from the comparator CM1 is set at a high level, and the output from the comparator CM3 is set at a low level. The output from the AND gate AND1 is set at a high level, the output from the AND gate AND2 is set at a low level, and the output from the AND gate AND3 is set at a low level. The outputs from the AND gates AND1 to AND3 are output at the terminals SL1 to SL3 through the OR gates OR1 to OR3, respectively. Similarly, when the output from the sensor SN2 is the highest, the terminal SL2 is set at a high level, and the terminals SL1 and SL3 are set at a low level. Similarly, when the output from the sensor SN3 is the highest, the terminal SL3 is set at a high level, and the terminals SL1 and SL2 are set at a low level. The selector selects one of the sensors SN1 to SN3, which generates the highest output, and supplies the highest output to the operational amplifier APM.

Figure 2:
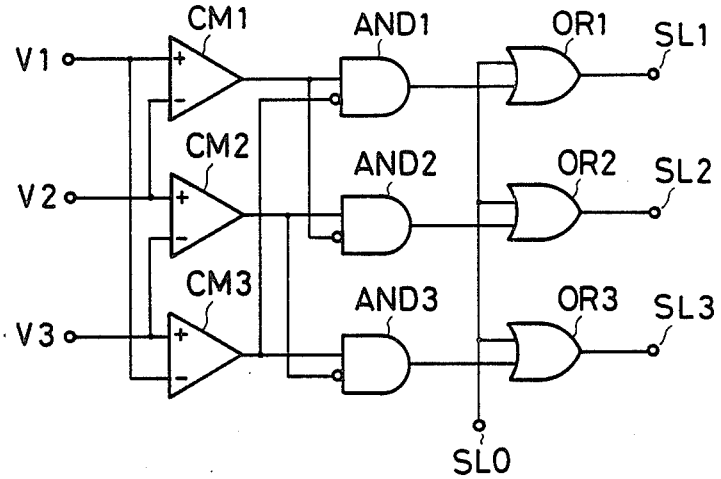
FIG. 2 is a block diagram of a selector used in the detector shown in FIG. 1.

The selector is not limited to the arrangement of FIG. 2. The selector can select two sensors in units of parameters (e.g., ionic smoke sensor and a photoelectric smoke sensor, or a constant temperature sensor and a differential temperature sensor in a fire alarm system). The selection of two sensors improves reliability of the detection of environmental abnormality performed by the central monitor. In the embodiment of FIG. 1, the operational amplifier is used as a simple adder. However, a multiplier may be used in place of the operational amplifier, if needed.

As is apparent from the above description, the composite detector of the present invention can simultaneously monitor a plurality of sensors in the normal monitor mode within a limited period of time. Furthermore, outputs from some or any of the sensors can be added in the central monitor, thereby providing environmental abnormality detection with high reliability.

When the sensors are automatically selected by the selector, data acquisition/processing time can be shortened. The central monitor can determine the type of abnormality according to the selected control signal, thus achieving accurate detection.

Although various minor changes and modifications might be proposed by those skilled in the art, it will be understood that I wish to include within the claims of the patent warranted hereon all such changes and modifications as reasonably come within my contribution to the art.

I claim as my invention:

1. A composite detector system, comprising:

a plurality of sensor means for detecting physical phenomena defined by at least one of the parameters heat, smoke, and gas according to different principles of detection, and for outputting analog detection signals;

a plurality of normally closed analog switches connected to outputs of said plurality of sensor means;

selector means for opening one or more of the analog switches and operated with a control signal from a monitor circuit means for determining a system situation for which the selector means is to be operated; and operation circuit means for deriving a composite output based upon a combination of all of said analog detection signals fed through said plurality of normally closed analog switches.

2. A detector according to claim 1 wherein said selector means selects one of said analog switches which corresponds to one of said sensor means which generates a highest output.

3. A detector according to claim 1 wherein said selector means outputs respective analog signals for controlling said analog switches.

4. A detector according to claim 1 wherein said operation circuit means comprises an operational amplifier.

5. A detector according to claim 1 wherein all outputs from said plurality of sensor means are input to said operation circuit means, and said selector means causing an output from one of said plurality of sensor means to said operation circuit means when said monitor circuit means determines that an output from said operation circuit means exceeds a predetermined value.

6. A detector according to claim 1 wherein said selector means comprises comparators, AND gates respectively connected to said comparators and having inverting and noninverting input terminals, and OR gate means respectively connected to said AND gates for supplying control signals to said analog switches.

7. A composite detector system, comprising:

at least wo sensor means each for detecting a different environmental parameter and for outputting respective analog detection signals;

a plurality of normally closed analog switches each of which is connected to receive one of said analog detection signals from a respective one of the sensor means;

selector means having outputs connected to respective ones of the analog switches for selectively opening the same and inputs connected to respective ones of said sensor means;

output circuit means for combining outputs from all of the plurality of analog switches so as to provide a composite output signal; and monitor circuit means connected to control the selector means and for determining a system situation for which the selector means is to be operated so as to selectively open at least one of said analog switches.

8. A detector system according to claim 7 wherein the monitor circuit means connects to an output of the output circuit means and detects a particular output condition so as to energize the selector circuit means.

9. A detector system according to claim 8 wherein the monitor circuit means comprises a comparator with a following latch connecting to the selector circuit means.

10. A detector system according to claim 7 wherein said selector means open the analog switch connected to the sensor means having a highest analog detection signal compared to analog detection signals from the other sensor means.

* * * * *